United States Patent [19]

Yamana

[11] 4,404,420

[45] Sep. 13, 1983

[54] COMBUSTION DETECTING ELEMENT

[75] Inventor: Toshifumi Yamana, Nagoya, Japan

[73] Assignee: Rinnai Kabushiki Kaisha, Aichi, Japan

[21] Appl. No.: 292,937

[22] Filed: Aug. 14, 1981

[30] Foreign Application Priority Data

Feb. 8, 1980 [JP] Japan ..... 55-13605

[51] Int. Cl.[3] ..... H01L 35/28

[52] U.S. Cl. ..... 136/217; 431/76; 431/80

[58] Field of Search ..... 136/217, 220; 200/61.03; 431/76, 80

[56] References Cited

U.S. PATENT DOCUMENTS 3,616,274 10/1971 Eddy ..... 431/76
4,125,356 11/1978 Ohashi et al. ..... 431/76
4,140,475 2/1979 Wolfe ..... 431/76

FOREIGN PATENT DOCUMENTS 2065862 7/1981 United Kingdom ..... 431/76

*Primary Examiner*—Leland A. Sebastian
*Attorney, Agent, or Firm*—Armstrong, Nikaido, Marmelstein & Kubovcik

[57] ABSTRACT

A combustion detecting element is provided which comprises an element body generating an electric change which corresponds to a difference in oxygen concentration between a first surface and a second surface thereof. Catalytic electrode layers are provided on both surfaces for carrying out catalytic reaction with combustible gas and a lead wire is connected to each layer, the catalytic electrode layers being characterized in that each catalytic electrode layer has substantially different capabilities in catalytic reaction with combustible gas.

2 Claims, 3 Drawing Figures

COMBUSTION DETECTING ELEMENT

BACKGROUND OF THE INVENTION

This invention relates to a combustion detecting element for detecting incomplete combustion of a burner.

Various devices are known in the prior art for detecting incomplete combustion having an element body made of zirconia or the like which generates an electric change, for instance, electromotive force, corresponding to an oxygen concentration difference between one side surface of the body and the other side surface of the body. These devices are generally provided on both side surfaces with equal-sized catalytic electrode layers, for instance, porous platinum electrode layers for carrying out a catalytic reaction with combustible gas.

The element is, for instance, with one side surface (hereinafter the "first surface") thereof facing a burner to be monitored while the other side surface (hereinafter "the second surface") thereof is exposed to a combustion flame of a standing burner, which is burning continuously and impinging on the second surface. With this arrangement, oxygen is consumed in a catalytic combustion reaction of the combustible gas in the flame of the standing burner in the catalytic electrode layer on the second surface. As a result, the oxygen concentration on the second surface side is lowered. In a normal condition, a difference in oxygen concentration is obtained between the second surface and the first surface. However, if there occurs incomplete combustion of the burner being monitored, the flame of the burner contacts the catalytic electrode layer on the first surface. The oxygen concentration on the first surface is lowered by consumption of oxygen caused by the catalytic reaction which is the same as that occurring in the second surface. Thus, the oxygen concentration difference between the two surfaces is decreased and an electric change corresponding to this is produced in the element. In this manner, incomplete combustion in the burner being monitored can be detected. However, a certain disadvantage is present in these prior art devices in that the catalytic reaction of the combustible gas contained in the flame of the standing burner on the catalytic electrode layer on the second surface reduces the oxygen concentration on the second surface to a tremendous degree. It takes a large amount of time before the oxygen concentration on the first surface is lowered enough to a predetermined value in comparison with the oxygen concentration on the second surface after the flame of the burner being monitored comes into contact with the catalytic electrode layer on the one side surface because of incomplete combustion. Thus, these devices are not quickly responsive.

BRIEF SUMMARY OF THE INVENTION

This invention has as an object to provide a combustion detecting element which is quickly responsive.

The present invention is a combustion detecting element having an element body generating an electric change corresponding to a difference in oxygen concentration between a first surface and a second surface thereof, and catalytic electrode layers on both surfaces for carrying out catalytic reaction with combustible gas, characterized in that the catalytic electrode layers on both surfaces are so prepared to make a difference therebetween in their abilities for catalytic reaction with combustible gas.

DETAILED DESCRIPTION OF A PREFERRED EMBODIMENT

Figure 1:
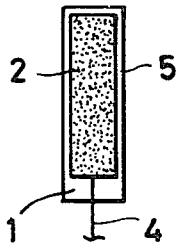
FIG. 1 is a front side view of the present invention.
Figure 2:
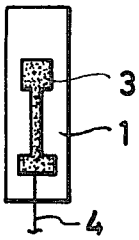
FIG. 2 is a rearside view thereof.

One embodiment of this invention is explained with reference to the accompanying drawings as follows:

A combustion detecting element is constructed of an element body 1 comprising a sintered body of oxygen-ion-conductive solid electrolyte, such as zirconia or any other material. Catalytic electrode layers 2,3 are formed on opposite surfaces thereof comprising porous platinum electrodes. Leading wires 4,4 are connected to the respective electrode layers 2,3. In this case, the first electrode layer 2 on the first surface is formed so as to cover almost all of the area of the first surface with a small marginal region 5 being left at the peripheral edge of the first surface, as clearly shown in FIG. 1. The second electrode layer 3 on the second surface is formed so as to cover a small area roughly at the center region of the second surface as clearly shown in FIG. 2. As an example, the area of the electrode layer 2 is eight times larger than the area of the electrode layer 3. The difference in area can be from to times. Thus, by the difference in size of area, the two electrode layers 2,3 have a definitive difference in their capabilities for catalytic reaction with combustible gas. Namely, the first electrode layer 2 of the new large area is larger in contact reaction area with combustible gas than the second electrode layer 3 of the smaller area, so that its catalytic reaction capability or capacity is larger. Thus, the amount of combustible gas capable of being reacted is considerably larger on the first surface compared to the second surface and, accordingly, the amount of oxygen capable of being consumed is increased in accordance therewith. It is also possible to make the difference in catalytic reaction capability by making a difference in the porosity or the thickness between the respective electrode layers 2,3.

Figure 3:
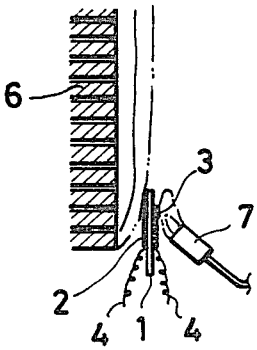
FIG. 3 is a side view, partly in section, showing the present invention in use.

The operation of this invention element as above is explained as follows:

The element is arranged having the first electrode layer 2 thereof facing the front surface of a burner 6 with a space left therebetween, while the second electrode layer 3 is constantly exposed to a combustion flame of a standing burner 7 or the combustion exhaust gas thereof, as shown in FIG. 3.

With this arrangement, in a normal condition, oxygen is consumed by the catalytic reaction with the combustible gas in the combustion flame or the exhaust gas of the standing burner 7 on the second electrode layer 3. As a result, the oxygen concentration in the second electrode layer 3 is lowered and, consequently, there is produced a large oxygen concentration difference between the second electrode layer 3 and the first electrode layer 2. An electromotive force is generated in the element body 1. If, however, incomplete combustion of the burner 6 occurs due to lack of oxygen or sudden increase in fuel or the like, the combustion exhaust gas of the burner 6 so expands outwardly to a zone shown by dotted lines in FIG. 3 from a condition shown by a solid line in FIG. 3 as to come into contact with the first electrode layer 2 facing the same. Upon contact, a catalytic reaction begins in the first electrode layer 2. With the resultant lowering of oxygen concentration in the first electrode layer 2, a decrease in difference in oxygen concentration between the two electrode layers 2,3 is brought about. In accordance with this, the electromotive force is drastically decreased, which can result in the opening of a safety valve through a control circuit (not illustrated) connected to the leading wires 4,4.

According to this invention, the catalytic reaction capability of the first electrode layer 2 is so arranged as to be considerably higher than that of the second electrode layer 3 so that such an advantage is brought about that a difference in oxygen concentration between the first electrode layer 2 side and the second electrode layer 3 side is instantly decreased due to a large amount of oxygen consumption caused by the contact and catalytic reaction of the combustion exhaust gas of the burner being monitored with the first electrode layer 2. Thus, a good responsive detection of incomplete combustion can be performed.

The provision of an outer peripheral marginal region 5 of the first electrode layer 2 operates advantageously in that when the combustion flame of the standing burner 7 goes around over the edge thereof, the marginal region 5 prevents the flame from coming into contact with the first electrode layer 2 to make an erroneous operation of the layer 2. Thus, according to this invention, catalytic electrode layers on both side surfaces of an element body are so prepared as to make a difference therebetween in their capabilities in contact reaction with combustible gas for obtaining a combustion detection having a good responsiveness to incomplete combustion. Consequently, the above disadvantage with the conventional type detector is eliminated.

What is claimed is:

1. A combustion detecting element comprising an element body generating an electric change corresponding to a difference in oxygen concentration between a first surface and a second surface thereof, catalytic electrode layers on both surfaces for carrying out catalytic reaction with combustible gas and a lead wire connected to each layer, characterized in that the catalytic electrode layers have substantially different capabilities in catalytic reaction with combustible gas and in that the element body is so arranged such that one surface of the element body having the catalytic electrode layer of the comparatively smaller catalytic reaction capability is exposed to an interior of a combustion atmosphere of a standing burner and the other surface thereof having the catalytic electrode layer of the comparatively larger catalytic reaction capability faces a burner of which a combustion condition is to be monitored.

2. A combustion detecting element as claimed in claim 1 wherein the catalytic electrode layer of comparatively larger capability is substantially larger in surface area than the catalytic electrode layer of comparatively smaller capability.

* * * * *